US008636274B2

(12) United States Patent
Ciampi et al.

(10) Patent No.: US 8,636,274 B2
(45) Date of Patent: Jan. 28, 2014

(54) STORING AND ISSUING DEVICE FOR BANKNOTES OR OTHER FLEXIBLE DOCUMENTS

(75) Inventors: Paolo Ciampi, Bollengo (IT); Carlo Simonotti, Bollengo (IT); Mirko Billet, Bollengo (IT)

(73) Assignee: CTS Cashpro S.p.A., Bollengo (FR)

( * ) Notice: Subject to any disclaimer, the term of this patent is extended or adjusted under 35 U.S.C. 154(b) by 382 days.

(21) Appl. No.: 12/522,421

(22) PCT Filed: Jan. 10, 2008

(86) PCT No.: PCT/EP2008/050261

§ 371 (c)(1),
(2), (4) Date: Jan. 19, 2010

(87) PCT Pub. No.: WO2008/087095

PCT Pub. Date: Jul. 24, 2008

(65) Prior Publication Data

US 2010/0133737 A1 Jun. 3, 2010

(30) Foreign Application Priority Data

Jan. 15, 2007 (IT) ..... TO2007A0018

(51) Int. Cl.
*B65H 5/22* (2006.01)

(52) U.S. Cl.
USPC ..... 271/3.01; 271/3.14; 271/4.03

(58) Field of Classification Search
USPC ..... 271/111, 3.01, 199, 4.03, 10.03, 182
See application file for complete search history.

(56) References Cited

U.S. PATENT DOCUMENTS

| | | | | |
|---|---|---|---|---|
| 6,647,328 | B2 * | 11/2003 | Walker | 701/36 |
| 6,834,808 | B2 * | 12/2004 | Satou et al. | 235/475 |
| 2002/0113160 | A1 * | 8/2002 | Niioka et al. | 242/528 |

FOREIGN PATENT DOCUMENTS

| | | |
|---|---|---|
| EP | 0 795 842 A2 | 9/1997 |
| EP | 1 405 808 A2 | 4/2004 |

* cited by examiner

*Primary Examiner* — Michael McCullough
*Assistant Examiner* — Howard Sanders
(74) *Attorney, Agent, or Firm* — Sughrue Mion, PLLC

(57) ABSTRACT

A storing and issuing device (11) for banknotes (12) and/or other flexible documents, for use in an equipment for the automatic processing of banknotes, in which the storing and issuing device includes a taking-up roller (50), a motor (60) for the taking-up roller, at least one transport belt (52) provided for wrapping on the taking-up roller (50) together with the banknotes (12) and holding means (53, 54, 79) actuatable for causing an entering banknote Bn(n) to be engaged with the transport belt (52). The storing and issuing device (11) comprises an electronic unit (65) for the holding means (53, 54, 79) and the motor (60) for the taking-up roller, for causing the entering banknote to be stored on the taking-up roller, with void space queuing providing substantial contact between the input edge of the entered banknote Bn(n) and the output edge of a last stored banknote Bn(n−1).

20 Claims, 10 Drawing Sheets

STORING AND ISSUING DEVICE FOR BANKNOTES OR OTHER FLEXIBLE DOCUMENTS

FIELD OF THE INVENTION

The present invention relates to a storing and issuing device for banknotes or other flexible documents.

More specifically, the invention relates to a storing and issuing device for banknotes and/or other flexible documents, for use in an equipment for the automatic processing of banknotes and/or documents, including a taking up roller, a motor for the taking up roller, at least one transport belt provided for wrapping on the taking up roller together with the banknotes and holding means actuatable for engaging an entering banknote and/or document to be stored with the transport belt.

BACKGROUND OF THE INVENTION

An equipment for the automatic processing of banknotes and devices of storage and issuing of the above mentioned type are known from Italian Patent N. 1.285.312, assigned to CTS Cashpro S.p.A, and counterpart European Patent EP 795 842. Equipments and devices according to these patents are broadly installed and appreciated by the market, for flexibility, velocity and high reliability.

The devices for storing and issuing banknotes by means of taking up rollers and transport belts are normally arranged in respective drawers, which are detachably mounted in equipments for the automatic deposit and withdrawal of banknotes. The storage of the banknotes is substantially limited by the maximum diameter allowed for the full taking up roller and it determines the number of banknotes processable by the equipment in which the drawers are mounted. Therefore need of the market is to increase the capacity of the these devices, without increasing the overall dimensions of the drawers and without reducing other operative features.

Devices for storing and issuing banknotes with taking up rollers and transport belts are often used for temporarily filing banknotes, in equipments having drawers or box with different kind of storage. Also in this case, the quantity of banknotes which can be processed by the equipment is conditioned by the diameter of the full taking up roller used for the temporary filing.

SUMMARY OF THE INVENTION

Object of the present invention is to increase the capacity of storage of a banknote processing device with taking up roller and transport belt, by maintaining unchanged dimensions, functional features and reliability with respect to a corresponding processing device of standard capacity.

As a matter of fact, the devices of storage and issuing, of the type with transport belts, store the banknotes on the taking up roller, generally in the sense of the shortest dimension, together with the transport belt, for instance constituted by one or two thin belts in mylar, leaving a gap or space between the edges of the adjacent queued banknotes. In a mode of issuing of the device, the separation of the banknotes from the taking up roller is made easier by a stripping blades, generally in plastics, continually creeping on the transport belt wound together with the banknotes.

The queuing space between the adjacent banknotes is necessary for a reliable storage without jams of the banknotes and to discriminate a banknote, relatively to a following one. This space is function of various parameters of the operative components, as: differences of diameter of the taking up roller, inaccuracy of the motion, differences of height of the banknotes, variation of time which can pass between a banknote and the following one, etc. The spread of these parameters is rather large, mainly when the device provides servomechanisms of open loop type. Under these conditions and given maximum diameter of the taking up roller and thickness of the transport belt, the effective quantity of storable banknotes is 20÷30% less than the theoretical quantity.

Moreover, the queuing spaces between the banknotes of the taking up roller determine deformations with respect to the cylindrical outline of the spool formed by the banknotes and the transport belt. It is particularly evident in condition of almost full taking up roller, with a further increase of the general dimensions. The deformations of the belt on which operates the stripping blade are also cause of noisiness, dynamic instability and additional wears of the belt and the stripping blade, with reduction of the operative life of the device.

Also storage with partial superimposition of the banknotes determines irregularities on the external diameter of the spool belt-banknotes in the taking up roller, which can cause similar drawbacks regarding the life of the transport belt and the stripping blade.

The object of the invention is accomplished by a storing and issuing device for banknotes or other flexible documents, for use in an equipment for processing banknotes, comprising a taking up roller, a motor for the taking up roller, at least one transport belts, and holding means actuatable for the engagement of the banknote with the transport belt and in which the transport belt is provided for wrapping on the taking up roller together with the banknotes. The device includes an electronic unit for the holding means and the motor of the taking up roller, for causing the banknotes to be stored on the taking up roller with substantial contact between the input edge of an entering banknote and the output edge of a last stored banknote.

The substantial contact between the edges of the stored banknotes or documents optimizes the filling of the taking up roller, with increasing of the number of banknotes or storable documents processable by the equipment, without modifying the mechanics, with reduction of the noisiness and improvement of the reliability.

The invention is also achievable as an electronic control module for use in storage devices of equipments for the automatic processing of banknotes and comprising a taking up roller, a stepping motor for the rotation of the taking up roller, at least one transport belt provided for wrapping on the roller together with the banknotes, holding means actuatable for causing the banknote to be engaged with the transport belt and a sensor of output for controlling the transit of the banknotes. The electronic module is pre-set for controlling the holding means and the motor of the taking up roller on the basis of physical parameters of the device, the height of the banknote and in response to signals from the sensor of output, so as to store the banknotes on the taking up roller with void space queuing providing substantial contact between the input edge of an entering banknote and the output edge of a last stored banknote.

BRIEF DESCRIPTION OF THE DRAWINGS

Further characteristics and advantages of the storing and issuing device for banknotes or other flexible documents according to the invention will appear clear from the following description given purely by way of non-limiting example, with reference to the attached drawings, in which.

DETAILED DESCRIPTION OF THE PREFERRED EMBODIMENTS

Figure 1:
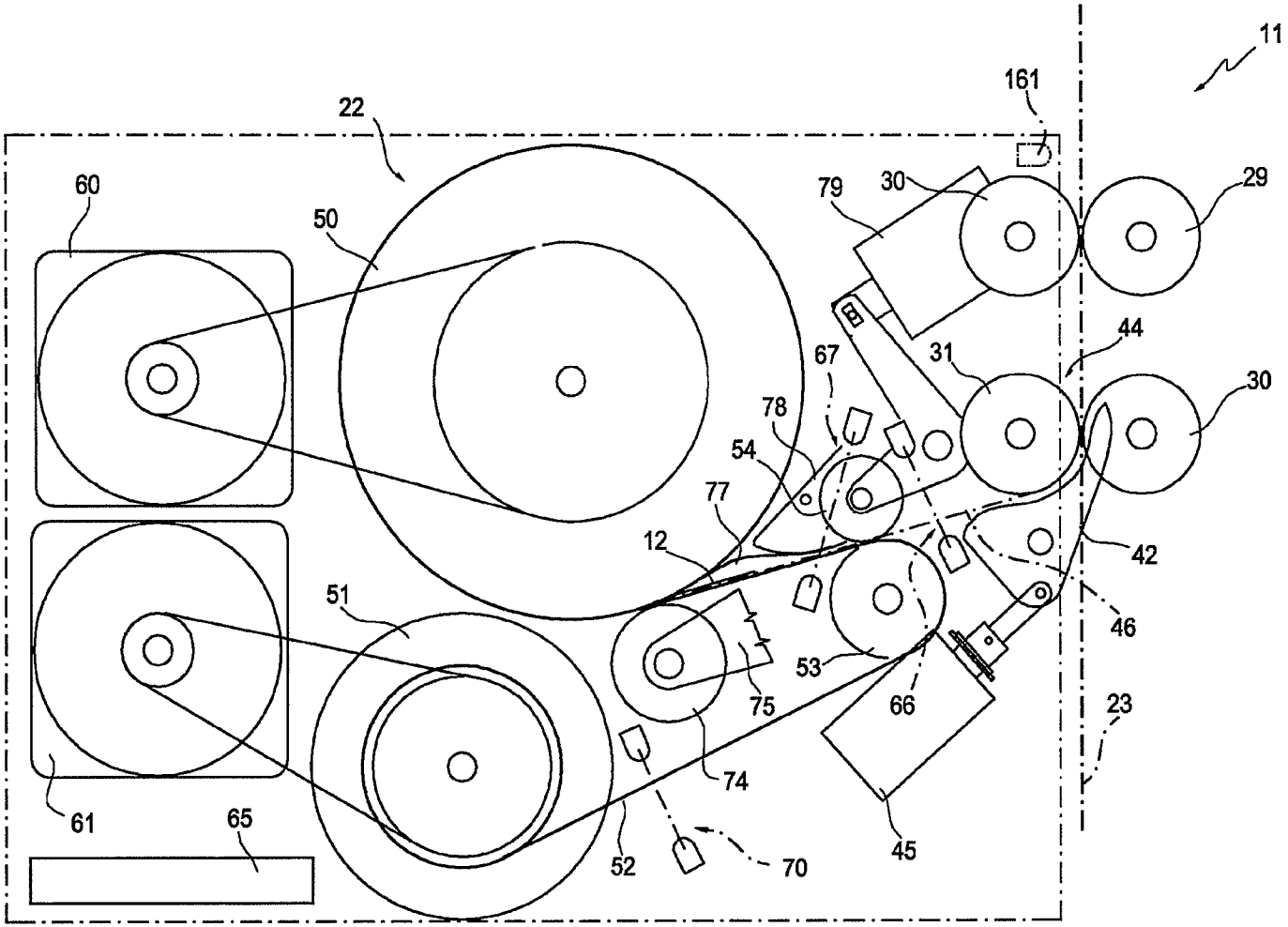
FIG. 1 is a schematic view which shows a storing and issuing device for banknotes or other flexible documents.

A device 11 for storing and issuing banknotes 12 or other flexible documents is illustrated, as an example and in schematic way in FIG. 1.

The device 11 is for use in a system or equipment 13 (FIG. 2) for the automation of cash activities. The equipment 13 comprises an upper body for the acquisition-issuing of banknotes or flexible documents and a lower body for the deposit of the banknotes or the documents and which constitutes a safe 17, in reciprocal communication through an opening 18. The device 11 and the equipment 13 are the subject of the above mentioned Italian Patent N. 1.285.312 or European Patent EP 795 842 and are herein described in summary way, with identical numeration for the components of similar functions.

The equipment 13 and the device 11 can process flexible documents, different from the banknotes, as checks and notes, and of which the dimensional characteristics are known. From here forward, the term banknotes will also designate these documents.

The upper body of the equipment 13 includes an input vane 15 to temporarily file and introduce the banknotes, two output vanes 16 for issuing the banknotes, an electronic control unit 19 and other mechanisms, not shown, which provide to move the banknotes between the vanes 15 or 16 and the opening 18. The safe 17 includes a plurality of lodgments 20 and a transport mechanism 21 controlled by the electronic unit 19, to further move the banknotes 12. Each lodgment 20 can accommodate a drawer 22 with a respective device 11 for the deposit of the banknotes 12, and in which each drawer is provided for storing a given denomination of banknotes. The drawers have identical mechanical structure, and the denomination of the banknotes processable by the drawer is defined by program.

In the mode of acquisition of banknotes by the equipment 13, the banknotes 12 are taken from the input vane 15, validated and distributed between the drawers 22 on the basis of the denominations; in the mode of issuing, the banknotes are moved from the drawers 22 toward the output vanes 16. The lodgments 20 are overlapped the one another, arranged according to two columns and in which the drawers 22 are accessible through a frontal door (not shown in the drawings). The transport mechanism 21 is provided to move the banknotes 12 along a vertical path 23 interposed between the two columns of lodgments 20 and aligned with the opening 18.

The transport mechanism 21 includes a stepping motor 24, a transmission belt 25 toothed on opposite faces, a pair of transport rollers 28 adjacent to the opening 18 and a pressure roller 29. The belt 25 substantially extends in vertical through the whole height of the safe 17, adjacent to the rear wall. A first branch of the belt extends between a return pulley 26 coaxial with the roller 29 and a tensioning pulley 27, while a second branch extends between the pulley 27 and a pulley of the motor 24. The rollers 28 are in mutual engagement, arranged by opposite sides with respect to the path 23 and connected in the rotation with the return pulley 26. The pressure roller 29 is keyed on the return pulley 26 and is arranged, on a side of the path 23 immediately underneath the rollers 28.

The drawers 22 are supported by guides of the lodgments 20 and are shiftable perpendicularly to the path 23 for the mounting and the removal. Moreover, the drawers 22 of a column are offset of few in height with respect to the drawers of the other column. Each drawer 22 includes, adjacent to an open side, a series of four transport rollers 30, 31, 32 and 33: the roller 31 has motor function and is interconnected in the rotation with the roller 33 by means of pulleys and toothed belts not shown in the drawings.

The rollers 30 33 are bidirectionally motorized by the transport mechanism 21 of the system 13. To this end, each drawer 22 has a toothed pulley integral in the rotation with the roller 31 and engageable with the teeth of the belt 25, while the tensioning pulley 27 maintains in tension the belt, independently of the number of the drawers mounted on the equipment. The rollers 30, 31, 32 and 33 of a drawer 22 arranged on a side of the path 23 are engageable by pressure with respective rollers arranged, in offset way, on the opposite sides of the path 23: the rollers 31, 32 and 33 of the drawers of left are opposed by the rollers 30, 31 and 32 of the drawers of right, while the roller 30 of the first drawer of left, the highest in figure, is opposed by the pressure roller 29. Thus, when the drawers 22 are in the lodgments 20, all the rollers 30 33 have the function of dragging for the banknotes 12, along the path 23, without solution of continuity.

Each drawer 22 includes a selection diverter 42 between the rollers 31 and 32, in an interface zone 44 (FIG. 1). This zone 44 corresponds to an area of engagement of the roller 31 with the pressure roller 29 of the transport mechanism 21 (see FIG. 2) or with the roller 30 or 32 of the drawer of the other column. The diverter 42 is actuatable by an electromagnet 45 to deviate the banknotes 12 between the vertical path 23 and a path 46, internal to the drawer and approximately horizontal.

In the mode of acquisition, the equipment 13 (FIG. 2) moves the banknotes 12 downwardly along the path 23, with counterclockwise sense of motion for the belt 25 and clockwise rotation of the rollers 30 33 for the drawers of left and, respectively, counterclockwise rotation of the rollers 30 33 for the drawers of right. The equipment 13 recognize the denominations of the banknotes and positions the diverters 42 to selectively distribute the banknotes from the path 23 to the various drawers 22 on the basis of the associated denominations and for being stored in the respective devices 11. The banknotes emerge from the opening 18 at a relatively high velocity Vtr and in a spaced way the one with respect to the other. It allows the diverters 42 of the various drawers 22 to deviate, on the fly, a banknote in transit, without interference with a preceding or following banknote.

In the mode of issuing, the equipment 13 moves the banknotes 12 upwardly along the path 23, with clockwise sense of motion for the belt 25, counterclockwise sense for the rollers 30-33 of the drawers at left in figure and clockwise sense for the rollers of the drawers at right. Then, the actuation of the electromagnet 45, through the diverters 42, allows the device 11 of the drawer associated to the respective denomination of banknote, to issue the stored banknotes from the path 46 of the drawers toward the path 23.

The device of storage and issuing 11 (FIG. 1) includes a taking up roller 50 for the banknotes 12, a feeding roller 51, at least one transport belt 52 and holding means actuatable for engaging the banknotes with the belt 52. In detail, the holding means includes a pair of pinch rollers 53 and 54 and an electromagnet 79. For the rotation of the taking up roller 50 and the feeding roller 51 are provided a motor 60 and, respectively, a motor 61. The rollers 50 and 51 are arranged at different heights, respectively, above and underneath the path 46.

In turn, the pinch rollers 53 and 54 are arranged below the path 46 and, respectively, above the path 46, at a side of the rollers 50 and 51. The motors 60 and 61 are stepping motors of known type, controlled as open-loop servomechanisms, which rotate the rollers 50 and 51 through suitable pulleys and toothed transmission belts.

The transport belt 52 is provided for wrapping and carrying out between the taking up roller 50 and the feeding roller 51 and cooperates with the pinch roller 53 having function of return member, tangent to the path 46. The belt 52 includes two thin belts, of transparent plastic material of high resistance, for instance mylar, arranged side by side. The taking up roller 50 is provided for storing in spool the banknotes 12 together with the two belts. The pinch rollers 53 and 54 are offset arranged along the path 46 included between the interface zone 44 and the taking up roller 50. Therefore, the path for each banknote 12 on the device 11 has a first portion, included between the interface zone 44 and the pinch rollers 53 and 54, which is limited by the diverter 42 and a second portion, between the rollers 53 and 54 and the taking up roller 50, which is delimited by the belt 52.

The pinch rollers 53 and 54 are provided for mutual shifting between a configuration of engagement with the banknotes 12 and a configuration of disengagement on control of the electromagnet 79. The pinch roller 54 has function of pressing member and is supported by a bridge, which is urged by spring toward the roller 53. The electromagnet 79, when de-energized, determines the configuration of engagement with engagement by pressure between the pinch rollers 53 and 54. When the electromagnet is energized, it determines the configuration of disengagement with the roller 54 spaced apart from the roller 53.

In the configuration of engagement, the pinch roller 54 presses on the belts supported by the portion of roller 53 which is tangent to the path 46, and the belts are provided to drag, by adherence, the banknote 12 interposed between the belts and the roller 54. In the configuration of disengagement, a banknote 12 can slide with low friction on the belts, underneath the roller 54.

First and second photoelectric sensors, conventionally Photo-Out 66 and Photo-In 67 detect the presence of the banknotes 12 in respective areas of detection, while an electronic unit, herein represented with 65, controls the actuation of the motors 60 and 61 and the electromagnets 45 and 79. The sensor 66 is interposed between the interface zone 44 and the pair of pinch rollers 53 and 54, while the sensor 67 is interposed between the pinch rollers 53 and 54 and the taking up roller 50. The sensors 66 and 67 are adapted to supply a signal PHOTO-OUT and, respectively, a signal PHOTO-IN, when a portion of a banknote 12 crosses the respective area of detection. A further sensor 70 is provided to recognize the passage of final portions of the belt, supplying a signal associated to a condition of taking up roller 50 full, and of taking up roller 50 empty.

The device 11 further includes an accompanying roller 74 supported by a pair of lever arms 75 and urged by spring toward the taking up roller 50 to cooperate with the most external coils of the spool of belt and banknotes wound on the roller. Specifically, the accompanying roller 74 presses the belts on the area of tangency of the spool with the section of belt 52 directed toward the roller 53. In the mode of storage of the device, it ensures a good adherence of the banknotes 12 with the spool for a whatsoever condition of filling of the taking up roller 50. Moreover, two stripping blades 77 cooperate with the external coils of the spool wound on the roller 50 in an area adjacent to the roller 74 to facilitate the separation of the banknotes 12 from the belts of the spool, in the mode of issuing of the device. After the separation, the blades 77 guide the banknotes to on the unwinding belts. The stripping blades 77 are in plastic material and are supported by a pair of lever arms 78 urged by spring.

Figure 4:
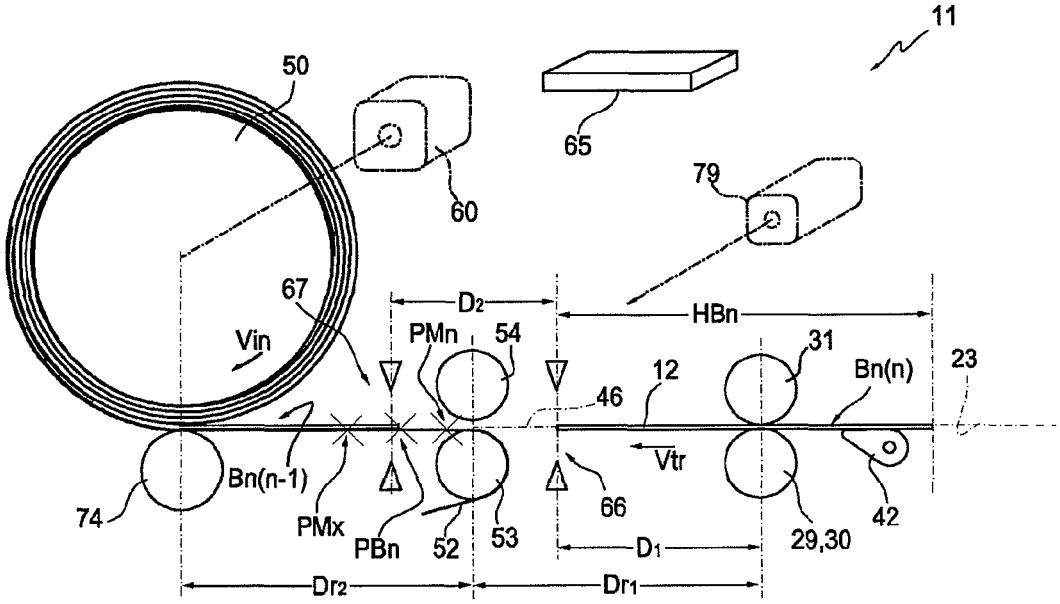
FIG. 4 represents a simplified view of the device according to the invention, in a condition of reference for the storage of banknotes.
Figure 5:
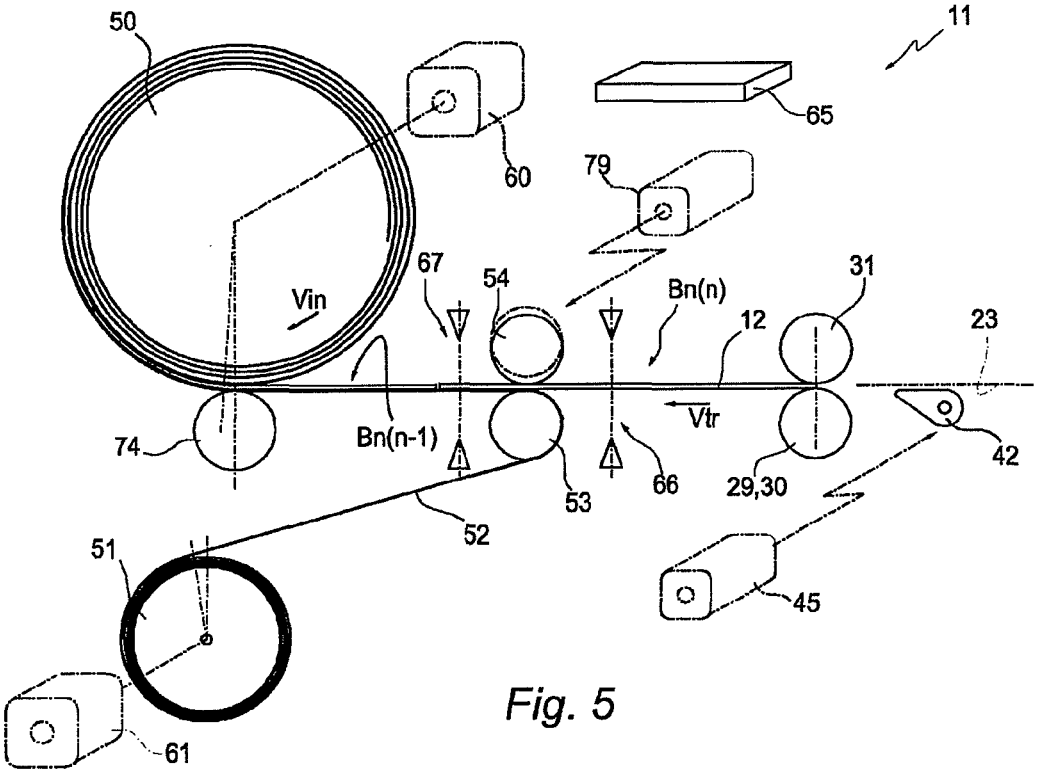
FIG. 5 shows the view of FIG. 4 in a first operative condition.

A simplified view of the device 11 according to the invention is represented in FIGS. 4 and 5. The path 46 between the rollers 30-33 and the taking up roller 50 has been represented as rectilinear, while the height HBn of the banknote 12 has been put in relation with physical parameters regarding some components of the device 11 which are operative along the path 46. In detail: Dr1 is the distance between the area of tangency of the rollers 31 and 29, 30 and the area of tangency of the rollers 53 and 54; Dr2 is the distance between the area of tangency of the rollers 53 and 54 and the area of tangency of the accompanying roller 74 and of the spool 50; and D1 and D2 are the distances between the area of tangency of the rollers 31 and 29,30 and the optical beams of the sensors Photo-Out 66 and Photo-In 67.

Figure 3:
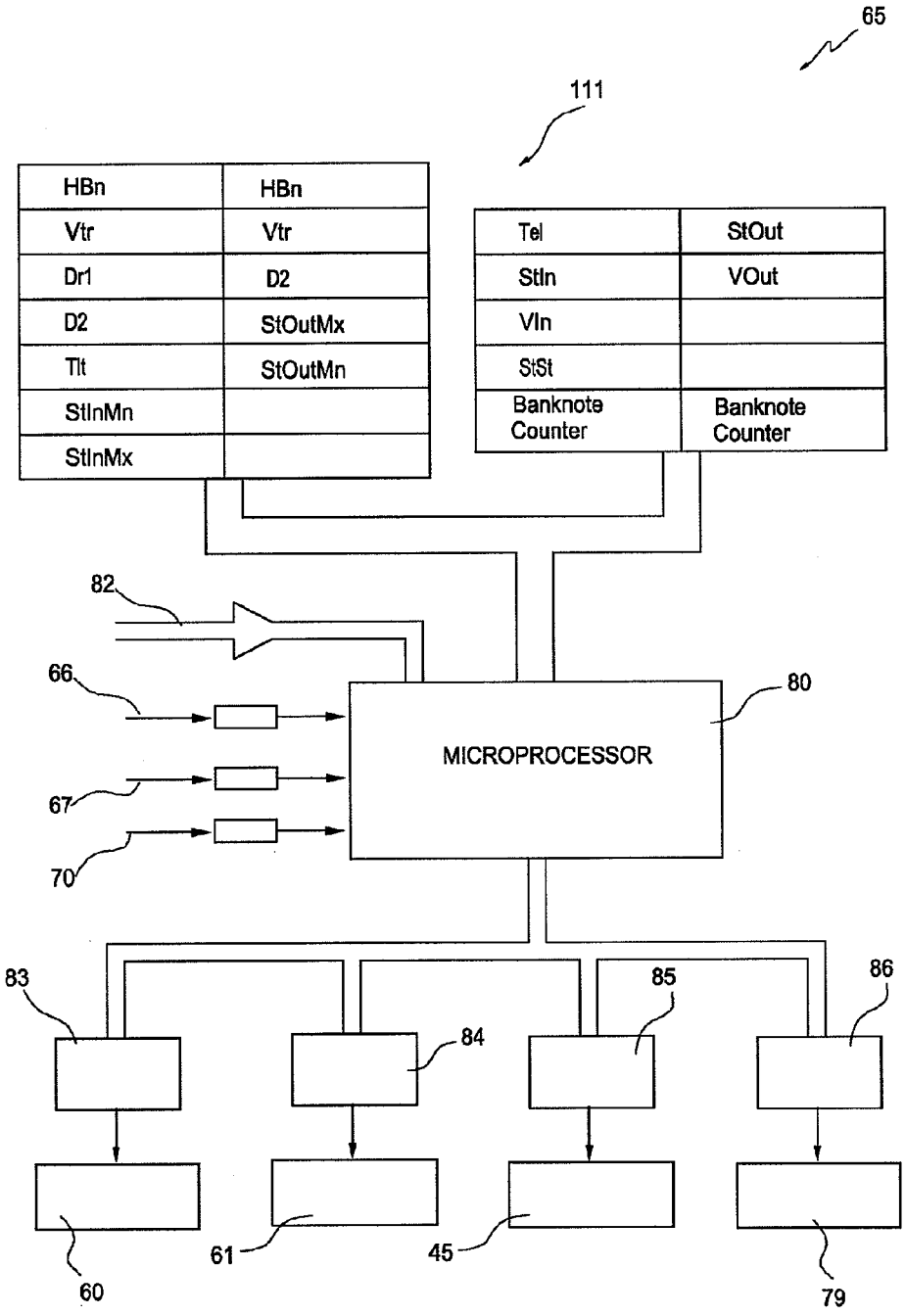
FIG. 3 is an electrical block diagram of the storing and issuing device for banknotes according to the invention.

With reference to FIG. 3, the electronic unit 65 includes a microprocessor 80, of high calculating speed, connected in input with the sensors 66, 67 and 70 and a line 82, in turn connected with the electronic unit 19 of the system 13. In output, the microprocessor 80 is connected, through driving circuits 83, 84, 85 and 86, with the motors 60 and 61 of the taking up roller and the feeding roller and with the electromagnets 45 and 79.

The electronic unit 65 (FIGS. 4 and 5) is provided to associate the configuration of engagement or the configuration of disengagement of the pinch rollers 53 and 54 to the presence of a banknote 12 detected by the sensor Photo-Out 66 and to other information processed by the device 11 or the equipment 13.

According to the invention, the electronic unit 65 controls the holding means for the engagement between banknote 12 and belt 52 and the motor 60 of the taking up roller 50 so as to store the banknotes on the taking up roller with void space queuing of the banknotes providing substantial contact between the leading or input edge of an entering banknote and the trailing or output edge of a last stored banknote.

Figure 2:
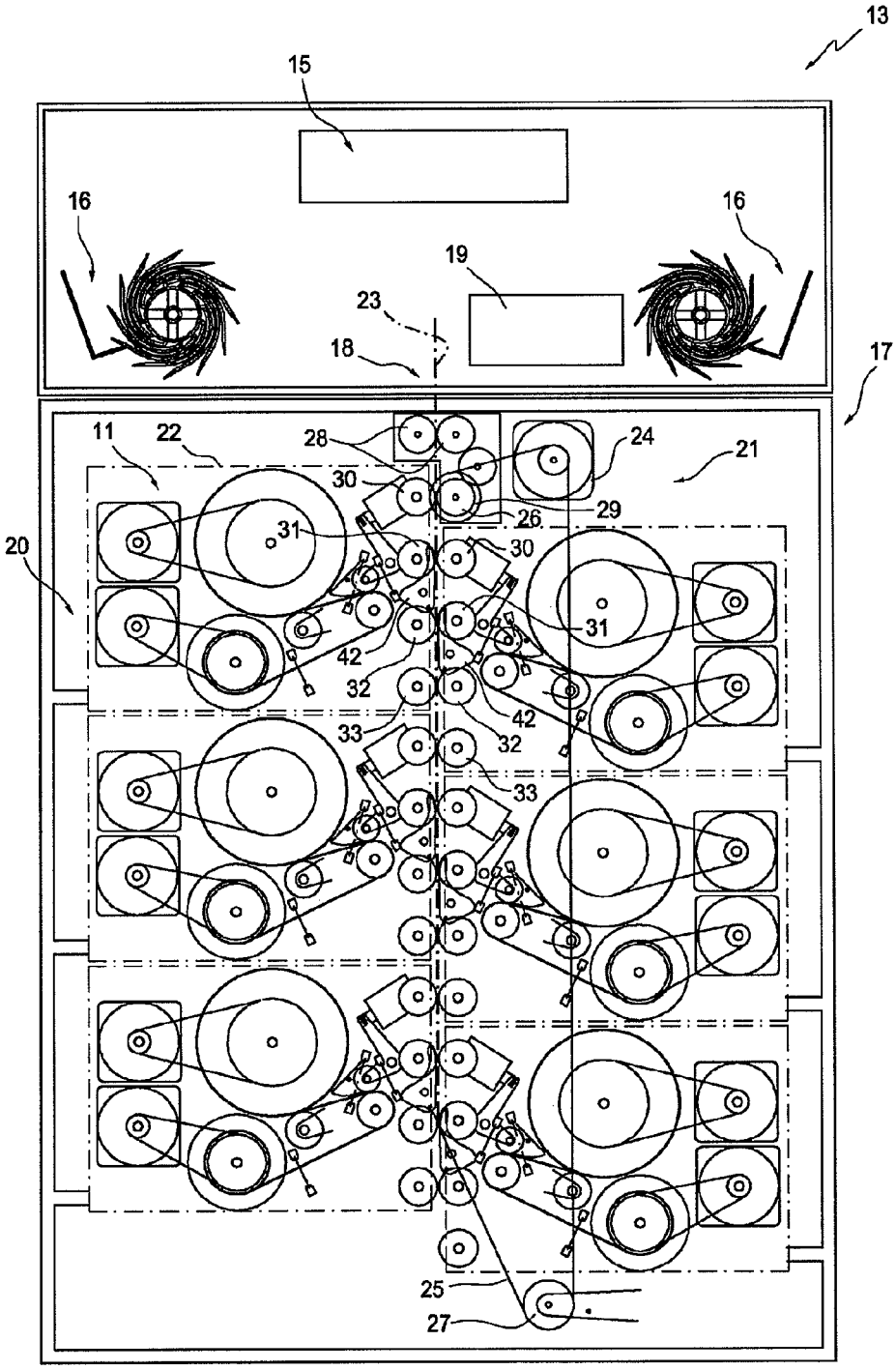
FIG. 2 shows a schematic view of an equipment for the automation of cash activities, which uses a plurality of the devices of FIG. 1.

For the storage of the banknotes 12 in the drawer 22, on control of the equipment 13 of FIG. 2, the electronic unit 65 actuates the electromagnet 45 (FIG. 1), by deviating the diverter 42 for the entering of the banknote 12 and actuates the electromagnet 79 for disengaging the pinch rollers 53 and 54.

Figure 16:
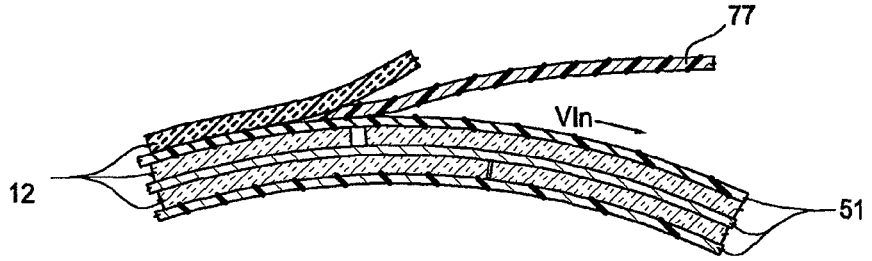
FIG. 16 shows, in schematic way, details on the storage of banknotes according to the invention.

The cycle of storage of the device 11 starts-up with the covering of the sensor Photo-Out 66 (FIG. 4) by the input edge of the banknote Bn(n) and generation of the signal PHOTO-OUT. On such event, the electronic unit 65 starts up the motor 60 of the taking up roller 50; further it calculates the time of de-energization of the electromagnet 79, so that the roller 54 engages the banknote when the same banknote has just leaved the rollers 31 and 29, 30 and the dragging motion by the equipment 13. The time of de-energization also corresponds to the time for the exact void space queuing of the entering banknote with the last stored banknote (FIGS. 5 and 16). Then, the banknote 12 will be integral in the movement with the belts which define the transport belt 52, under the action of the pinch rollers 53 and 54 and is dragged by the belt, for the action of the motor 60 on the taking up roller 50.

By the (calculated) time of engagement of the banknote Bn(n) with the roller 54, the electronic unit 65 begins to count the steps of the motor 60, up to the uncovering of the sensor Photo-Out 66 (FIG. 6) by the trailing edge of the entering banknote Bn(n), in association with the known distance D1 between the rollers 30 and 29,30 and the sensor Photo-Out 66. Then, the unit 65 calculates, in response to the number of effected steps, two positions as steps of the motor 60: 1) where spacing away the pinch roller 53 from the roller 54 for a following banknote Bn(n+1) to be stored; and 2) where stopping the banknote Bn(n) for exact positioning the output edge as function of the void space queuing at substantial contact of the following banknote Bn(n+1) (FIG. 7).

In detail, the electronic unit 65 includes a non-volatile memory 111 to store specific information of the equipment 13 and the drawer 22, and the number of the banknotes contained in the same drawer 22 to be processed for obtaining the whished result. For instance, the following operative parameters are used:

The height HBn of the denomination of banknotes handled by the drawer 22;

The transport velocity Vtr of the banknotes, along the path 23, defined by the equipment 13;

The reference distance D1 between the area of tangency of the rollers 31 and 29, 30 and the optical beam of the sensor Photo-Out 66.

The height HBn varies, for instance for the banknotes of the European system, between a minimum of 62 mm, for a banknote of 5 Euro, to a maximum of 82 mm for a banknote of 500 Euro. The minimum height is greater of the distance Dr1 and the distance Dr2: as example, these distances are about 60 mm. It can be applied for other monetary systems, providing that the distances Dr1 and Dr2 limits the minimum height of the denomination of banknote processable by the device 11.

The device 11 also uses, as fixed parameters:

The reference distance D2 between the optical beams of the sensors Photo-Out 66 and Photo-In 67;

The latency time TIt between the instant of de-energization of the electromagnet 79 and the instant of contact between the rollers 53 and 54, for the engagement of the banknote with the belts;

The number of steps StInMx necessary to the motor 60 to move the banknote through the distance D2, in condition of taking up roller 50 full; and The number of steps StInMn necessary to the motor 60 to move the banknote through the distance D2, in condition of taking up roller 50 empty.

On the basis of the stored information and the signals from the sensor Photo-Out 66, the electronic unit 65 updates a counter of banknotes of the drawer and calculates:

The de-energization time TeI for the electromagnet 79, beginning from the signal PHOTO-OUT of the sensor 66, so that the contact between the pinch rollers 53 and 54 occurs at the instant in which the banknote disengages the rollers 31 and 29, 30;

The number of steps StIn necessary to the motor 60 to move the banknote through the distance D2 under operative conditions;

The instantaneous peripheral velocity VIn of the taking up roller 50;

The number of steps StSt necessary to the motor 60 of the roller 50 to be arrested so that the output edge of the last stored banknote is in a reference position PBn associated to the height of the banknote.

The number of steps StIn is calculated and not detected because the detection through the sensors 67 and 66, in the conditions of substantial contact between the banknotes, could be negatively affected by the last stored banknote. The velocity VIn is obtained as pulses of control of the motor 60, associated to the diameter of the taking up roller 50 stored in the memory and referred to the detections and the calculations effected on the last stored banknote of the drawer. The law of motion of the velocity Vin provides an initial ramp of acceleration, a constant section VI1÷VIj (FIG. 8) depending on the parameters of the device 11 and the banknote, and a final ramp of deceleration, up to the arrest of the motor 60.

Conveniently, after the storage in the taking up roller 50 (FIG. 4), the trailing or output edge of the last stored banknote Bn(n−1) will have a position PBn depending on the height of the banknote between a position PMn and a position PMx. The position PMn is close to the area of tangency of the rollers 52 and 54 and a corresponding shorter banknote intercepts the optical beam of the sensor Photo-Out 66. The position PMx is spaced away from the area of tangency of the rollers 52 and 54 and a corresponding longer banknote does not interfere with the optical beam of the sensor Photo-Out 66.

The de-energization time TeI is calculated by the microprocessor 80 on the basis of the height HBn of the banknote associated to the drawer, the velocity Vtr, the distance Dr1 and by subtraction of the latency time TIt.

The steps of the motor 60 are suitably counted and the number of steps between the starting-up of the motor and the uncovering of the sensor 66, as end of the signal PHOTO-OUT, is used together with the distance D2 and the distance D1 to calculate the number of steps StIn. In turn, the velocity VIn is calculated on the basis of the distance D2, the height HBn and the steps StIn. Moreover, the microprocessor 80 calculates the steps StSt through further calculations based on the stored parameters. With the end of the signal PHOTO-OUT, the data StIns, VIn and StSt are stored in the memory 111 for the positioning of a following banknote to be stored.

Figure 8:
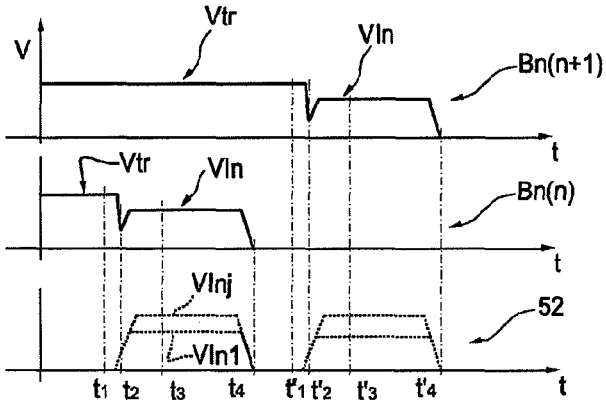
FIG. 8 shows a kinematic diagram of some components of the device according to the invention.

FIG. 8 shows, with reference to a cycle of storage, a multiple diagram velocity "V", time "t" of a banknote Bn(n) and a following banknote Bn(n+1), and the velocity VIn of the transport belt 52, and in which these velocities are referred to a common axis of time.

Figure 15:
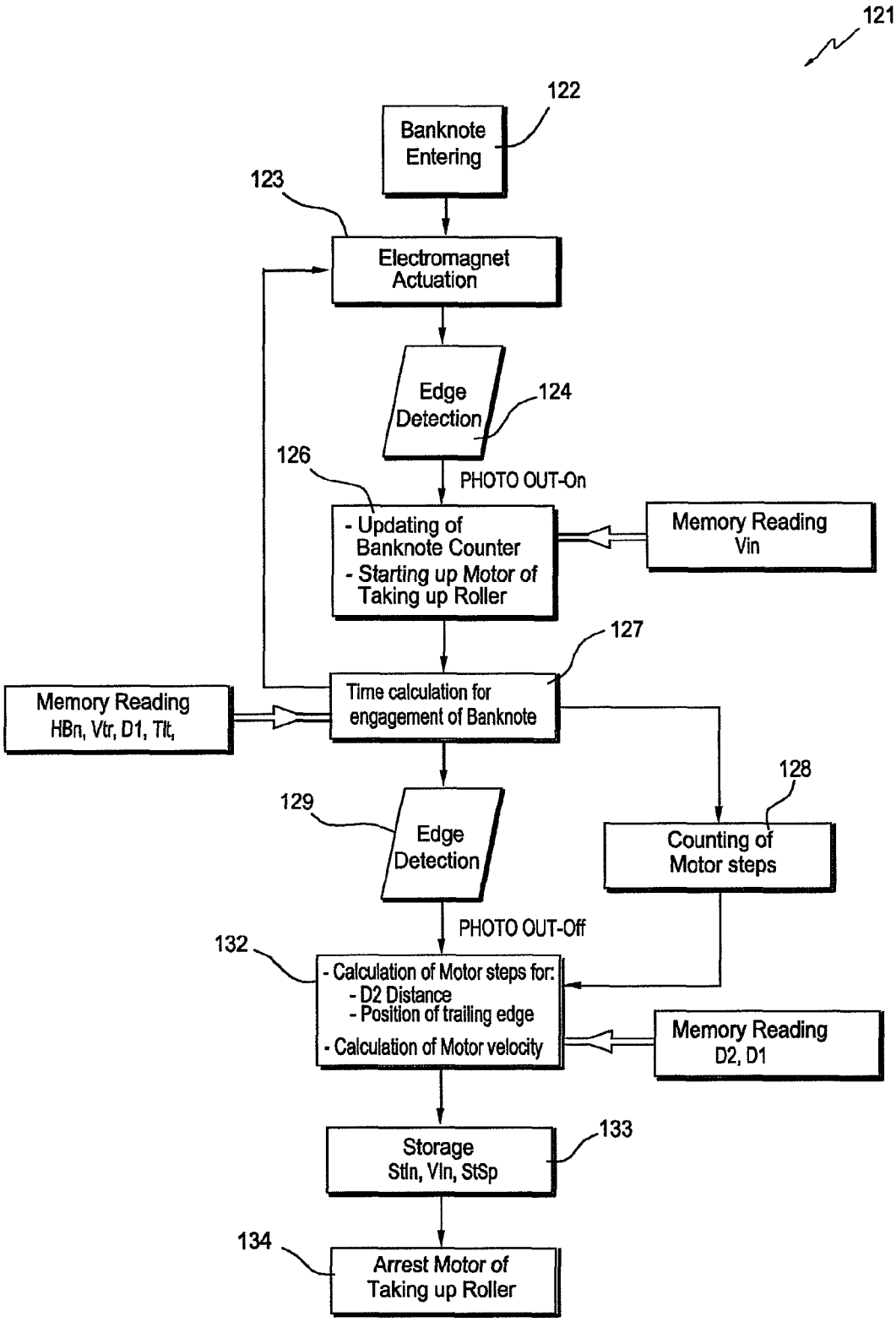
FIG. 15 represents a flow chart of the storing and issuing device of the invention regarding the storage of banknotes.

A simplified flow chart of a program for a cycle of storage of the device 11 is represented with 121 in FIG. 15. The cycle of storage is referred to the condition in which the equipment 13 transports the banknotes 12 at the velocity Vtr and has actuated the electromagnet of the diverter 42 in the device 11 associated to the specific denomination of the banknotes.

The banknote 12 Bn(ns) enters the drawer 22, block 122, while the electronic unit 65 actuates the electromagnet 79 in association with the actuation of the electromagnet 45 of the diverter 42, block 123, and the opening of the pinch rollers 53, 54. On the passage of the input edge of the banknote (time t1 of FIG. 8), the sensor generates the signal PHOTO-OUT, decision box 124, and reads in the memory the velocity VIn, starting up the motor 60 for the rotation of the taking up roller, block 126. The program also provides to update the counter of banknotes of the drawer. The banknote Bn(n) continues to be dragged at the velocity Vtr (FIGS. 4 and 8), while the peripheral velocity Vin of the roller 50, equal to the velocity of the belt 52, follows a ramp of acceleration for a velocity less of Vtr.

In a block 127, the program reads in the memory the parameters HBn, Vtr, D1 and TIt and calculates the de-energization time TeI for the electromagnet 79. Moreover, beginning from the time TeI, the program counts the steps of the motor 60, in a block 128, to calculate the reference steps of the motor associated to the passages of the input edge and the output edge of the entering banknote Bn(n. It for putting in relation these steps with the known height Hbn to determine the current diameter of the roller 50. The rollers 53 and 54 engage the banknote Bn(n) at the time t2 of FIG. 8, while the banknote is moving at the velocity Vtr (FIGS. 5 and 8) and the peripheral velocity Vin of the taking up roller 50, less of Vtr, is still increasing. However, from the time of the engagement with the belt, the banknote Bn(n), already queued at contact with the preceding banknote Bn(n−1), will be moved at the velocity VIn.

The end of the signal PHOTO-OUT, decision box 129, is indicative of the passage of the output edge of the banknote Bn(n) through the sensor 66; it actuates, in the block 132, updated calculations for obtaining the void space queuing of the banknote. For this calculation, the program reads the steps of the motor 60, block 128, and the parameters D2 and D1 to determine StIn, re-calculate the velocity VIn and determine the steps StSt lacking to the arrest of the motor. The passage of the output edge occurs at the time t3 of FIG. 8, while the banknote Bn(n) is still moving at the velocity VIn (FIGS. 5 and 8), substantially constant, between VIn1 and VInj, in dependence of the parameters regarding the current diameter of the roller 50 and the other stored parameters.

Figure 6:
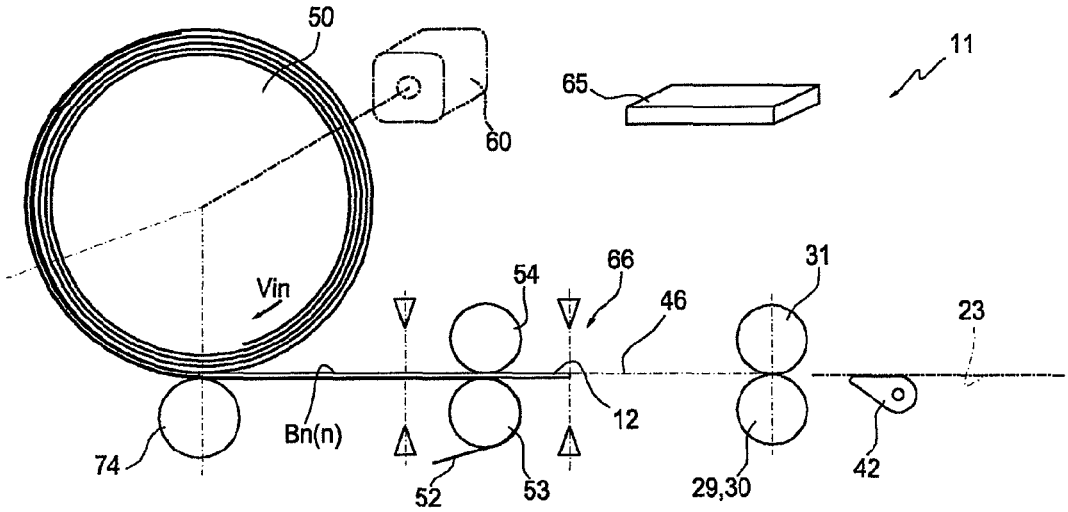
FIG. 6 is the view of FIG. 4 in a second operative condition.
Figure 7:
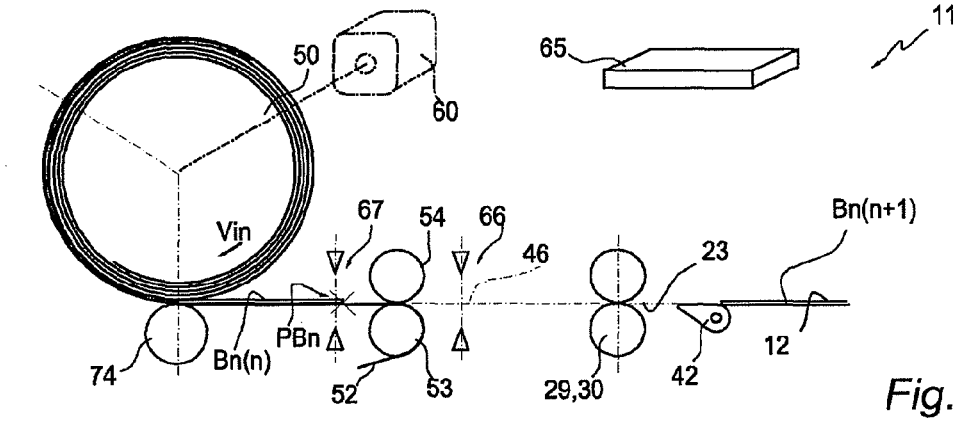
FIG. 7 represents the view of FIG. 4 in a third operative condition.

Thereafter, the velocity VIn progressively decreases up to the time t4 and the arrest of the banknote Bn(n) at the position PBn (FIGS. 6 and 8). A block 133 provides the storage of the calculated data STIn, VIn and StSt, to be used for the following banknote and block 134 provides the arrest of the motor 66, time t4. The law of motion imposed to the motor 60 is such that, at the moment of arrest of the motor, the input edge of a following banknote to be stored Bn(n+1) is upstream from the sensor Photo-Out 66 and the program can start up another cycle of storage at the time t1.

The storing and issuing device according to the invention accomplishes an exact cylindrical section for the spool of the banknotes 12 (FIG. 16) and the belts which constitute the belt 52. As non-limitative example, the substantial contact or void space between the edges of the adjacent banknotes is represented by a distance of queuing, without superimposition, of 0,0÷3,0 mm such to avoid substantial deformations in the belts which constitutes the belt 52 and excess of wear for the separating blade and the belts.

For the issuing of the banknotes, the electronic unit 65 controls the rotation of the feeding roller 61 and the rotation of the roller 50, if necessary, and the actuation of the holding means, so as to issue, in a spaced way, the banknotes 12, stored with void space queuing on the taking up roller 50.

Figure 9:
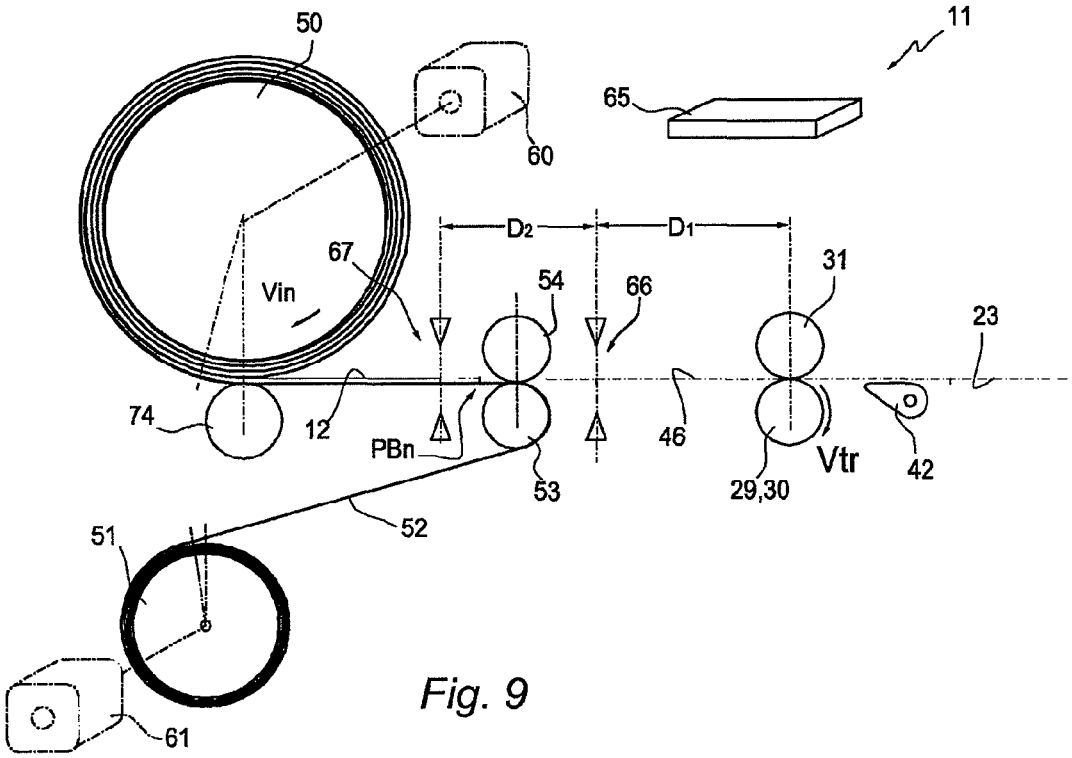
FIG. 9 represents a simplified view of the device according to the invention, in a condition of reference for the issuing of banknotes.
Figure 10:
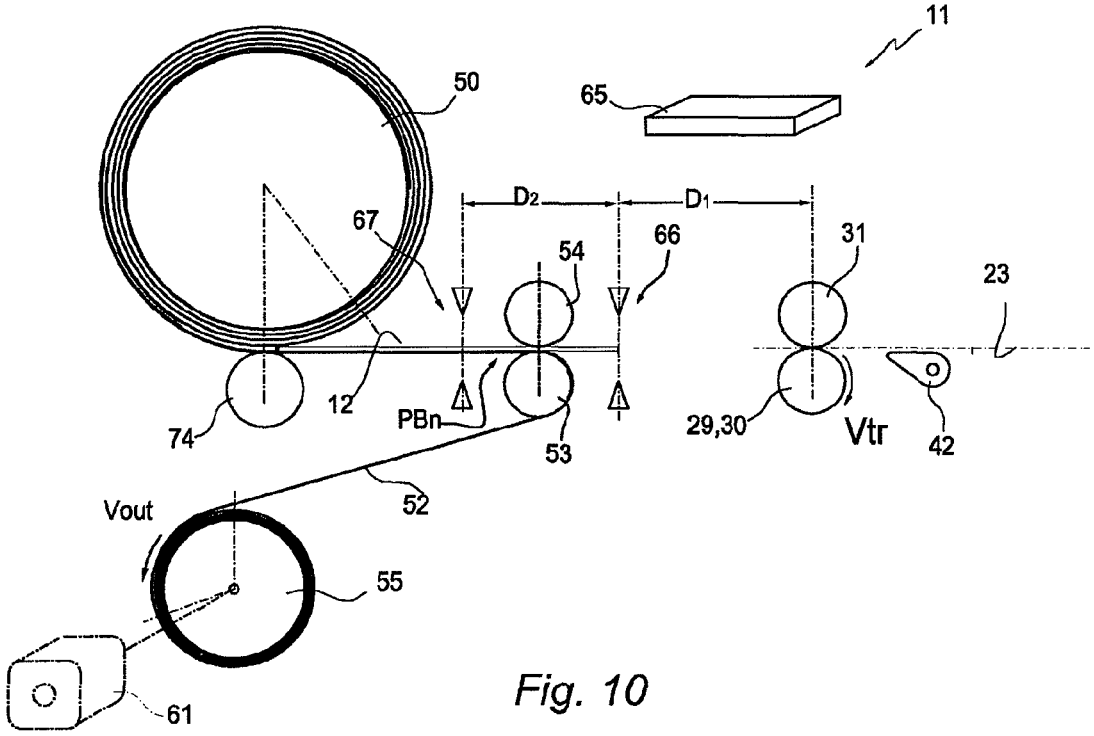
FIG. 10 shows the view of FIG. 9 in a first operative condition.
Figure 11:
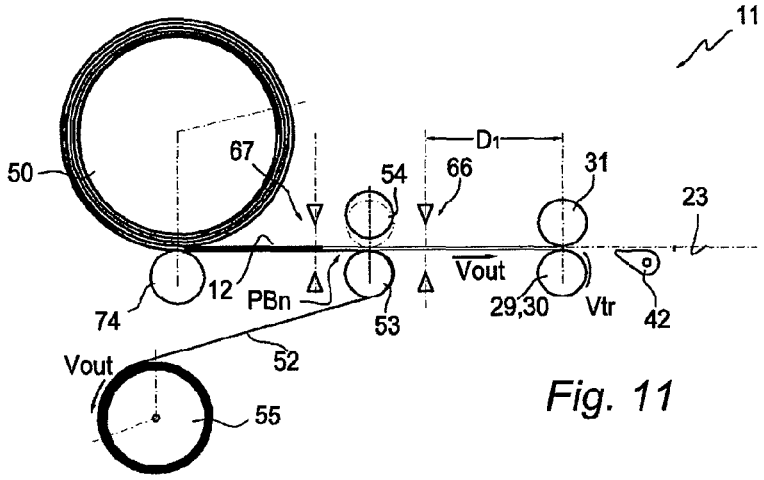
FIG. 11 is the view of FIG. 9 in a second operative condition.
Figure 12:
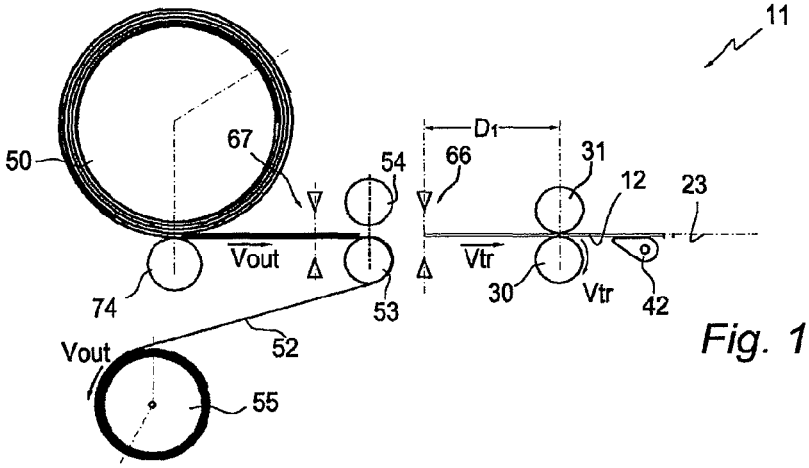
FIG. 12 represents the view of FIG. 9 in a third operative condition.
Figure 13:
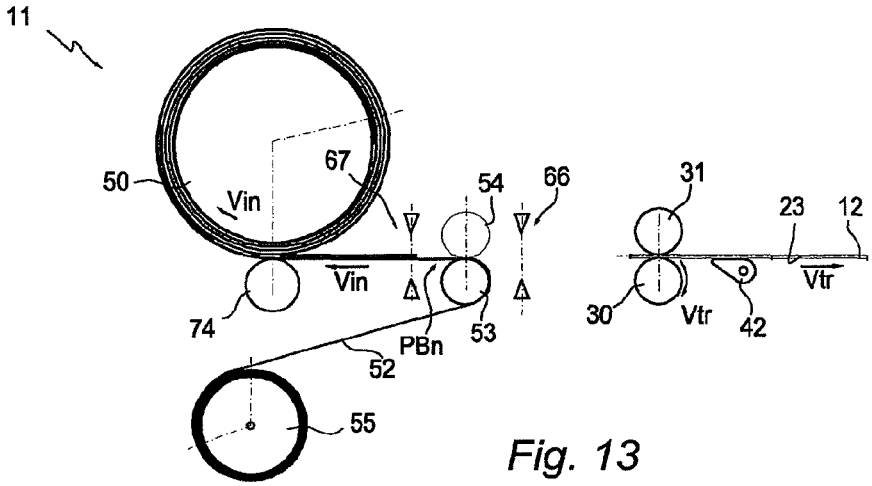
FIG. 13 shows the view of FIG. 9 in a fourth operative condition.
Figure 14:
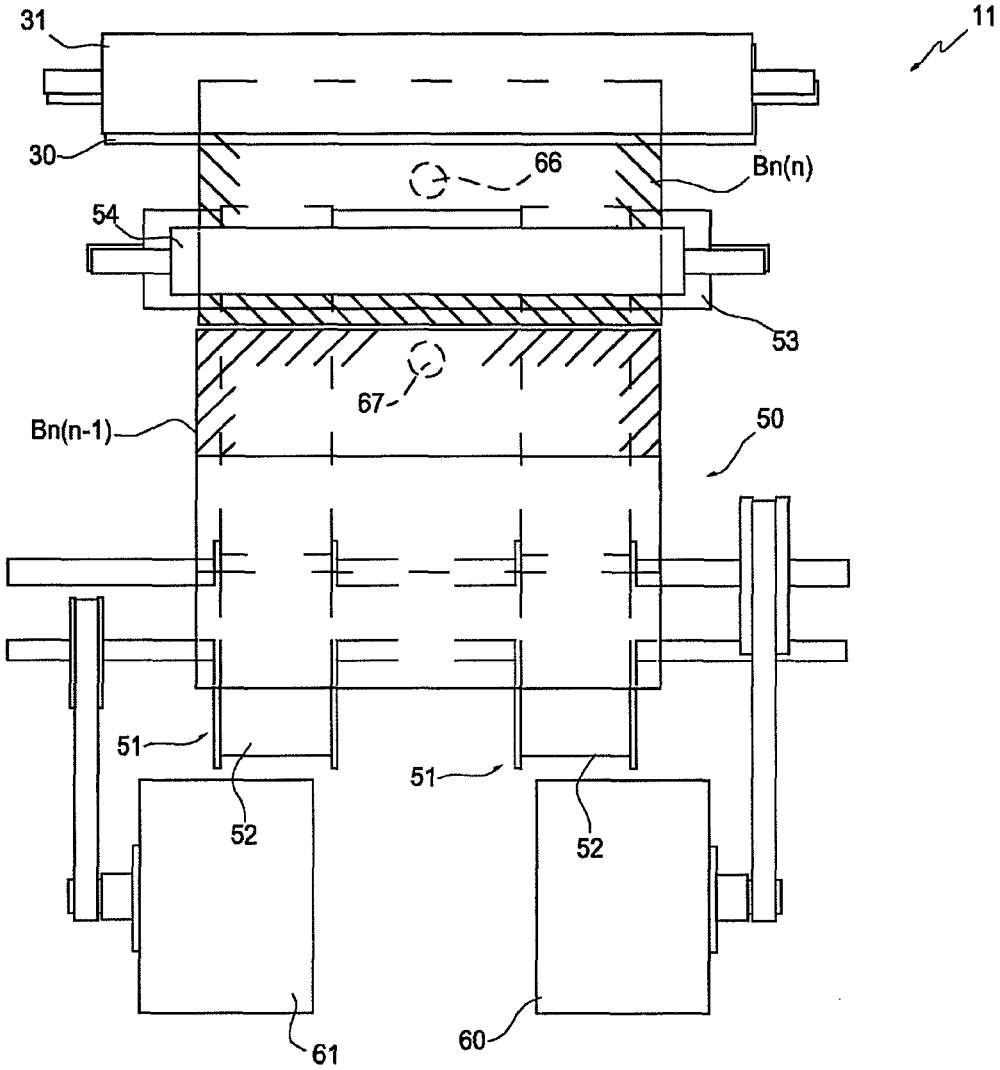
FIG. 14 is a schematic plan view of the device of storage and issuing according to the invention.

On control of the equipment 13, the cycle of issuing of the banknotes is preceded by a preparatory step (FIG. 9) which provides uncovering of the sensor Photo-In 67 by the trailing edge of the last wound banknote 12. By the uncovering of the sensor Photo-In, the electronic unit 65 starts up the motor 61 of the feeding roller 51 at a minimum velocity. When the trailing edge of the stored banknote, now leading edge of the issuing banknote, covers the sensor Photo-In 67, the signal PHOTO-IN is generated and the electronic unit 65 begins to count the steps of the motor 61 up to the covering of the sensor Photo-Out 66 (FIG. 10), which corresponds to the known distance D2. Then, the program calculates safety parameters, in response to the number of effected steps, and actuates the motor 61 for a peripheral velocity VOut of the feeding roller 55, less of Vtr. Thereafter (FIG. 11), it shortly actuates the electromagnet of the pinch rollers 53, 54 to make easier the issuing of the banknote, up to the engagement of the banknote with the rollers 31 and 29, 30 (FIG. 12). Now the banknote accelerates its velocity up to the value Vtr, quickly leaving the preceding banknote, and uncovers the sensor Photo-Out 66. Then, the banknote emerges from the drawer 22 and is deviated along the path 23, at the transport velocity Vtr.

The current diameter of the taking up roller 50 is calculated on the information from the sensors Photo-In and Photo-Out at the moment of issuing of the first banknote. For the following banknotes, wound at substantial contact, the diameter is calculated according to an algorithm of issuing based on the diameter regarding the last banknote, the number of the banknotes issued after the first one and the height of the same banknotes.

When the trailing edge of the issuing banknote uncovers the sensor Photo-Out 66, the program decrements the counter of the issuing banknotes, for updating the count of the diameter of the taking up roller 50 on the basis of the algorithm of issuing. At the end of the cycle of issuing, the program executes a cycle of final preset on the basis of information from the sensors Photo-In and Photo-Out, with actuation of the motor 60 of the taking up roller to position the edge of the last stored banknote at the corresponding position PBn.

In detail, the electronic unit 65 stores in the non-volatile memory 111, as operative parameters for the issuing, the number of the banknotes contained in the drawer 22 and the following information:

The height HBn of the denomination of the handled banknotes;

The transport velocity Vtr of the banknotes 12 along the path 23;

The reference distance D2 between the sensors 66 and 67;

The number of steps StOutMx necessary to the motor 61 of the feeding roller 51 to move the banknote through the distance D2, in condition of feeding roller full; and The number of steps StOutMn necessary to the motor of the feeding roller 51 to move the banknote through the distance D2, in condition of roller 51 empty.

On the basis of the stored information and the signals from the sensors Photo-In 66 and Photo-Out 67, the electronic unit 65 updates the counter of banknotes of the drawer and calculates:

The number of steps StOut necessary to the motor 61 of the feeding roller 51 to move the banknote through the distance D2, in operative condition; and The peripheral velocity VOut of the feeding roller 51.

Figure 17:
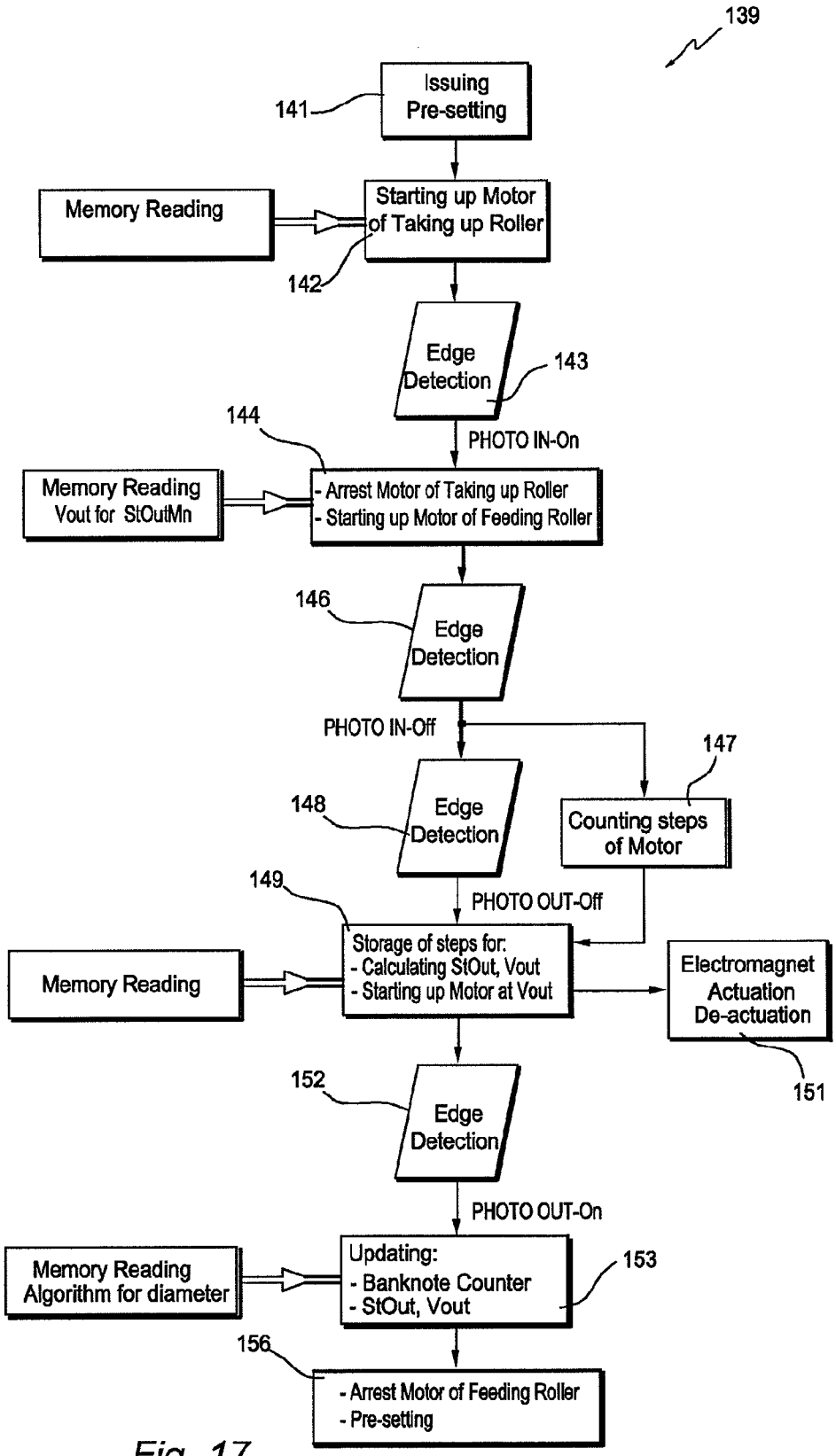
FIG. 17 is a flow chart of the device of the invention regarding the issuing of banknotes.

A simplified flow chart of the cycle of issuing is represented with 139 in FIG. 17. The cycle of issuing is referred to the condition in which the equipment 13 is pre-set for transporting the banknotes at the velocity Vtr and has actuated the diverter 42 of the device 11 associated to the denomination of the banknote 12 for deviating the banknote toward the path 23.

The cycle of issuing begins with a preparation step, block 141, in which the program starts up the motor 60 of the taking up roller 50, block 142, to rewind of few the last stored banknote, up to uncover the sensor Photo-In 67, decision box 143 (See also FIG. 9), in the case in which the sensor is covered. It follows the arrest of the motor 60 and the start up of the motor 61 of the feeding roller 51, block 144, with uncovering of the sensor Photo-In 67, decision box 146, calculation of the steps, block 147 and detection of the trailing edge by the sensor Photo-Out 66 (FIGS. 10 and 17), decision box 148.

The program proceeds, in block 149, to store the steps of the motor 61 for calculating the steps StOut and Vout and actuates the electromagnet 79 for the predetermined time, functional to the releasing of the banknote, block 151. At the detection of the passage of the trailing edge, decision box 152, the program, block 153, reads in the memory the velocity VOut for the motor 61 of the feeding roller 51 on the basis of the stored parameters.

To the block 153 follows block 154, of arrest for the motor 61 of the feeding roller and for a cycle of preset for a following state of the device.

Naturally, the principle of the invention remaining the same, the embodiments and the details of construction of the device for the storage and the issuing of banknotes can be widely varied with respect to what has been described and illustrated, by way of non-limitative example, without by this departing from the ambit of the present invention.

For example, position encoders for the roller 54 or optic sensors of position for the belt 52 can be provided, with simplification of the controls, in front of higher cost. Instead of a single transport belt, the wrapping of the banknotes can be effected through two overposed transport belts which engage the banknotes on both the faces. Viceversa, single belt which engages the central portion of the banknotes can be provided.

The device 11 can also be used for storing, with void space queuing, more denominations of banknotes in a single taking up roller. In this case, the device can provide, at the input, a sensor 161 (FIG. 1) to recognize the height of the entering banknote and the memory 111 will store the dimensions and the sequence of the stored banknotes.

The electronic unit can be accomplished, as electronic control module, for devices of storage and issuing already existing for use in equipments for the automatic processing of banknotes, in substitution or addition of the electronic unit of the existing devices.

We claim:

1. Storing and issuing device for banknotes and/or other flexible documents, for use in an equipment for the automatic processing of banknotes including a transport mechanism for moving entering banknotes serially and in a spaced way, wherein said storing and issuing device handles banknotes of a given height and includes a taking-up roller, a motor of the taking-up roller, at least one transport belt provided for wrapping on the taking-up roller together with the banknotes, a sensor of output for detecting the passage of an entering banknote, holding means actuatable for causing the entering banknote to be engaged with the transport belt, a driving circuit defining a servomechanism for the motor of the taking-up roller, and an electronic unit for the holding means and said driving circuit said storing and issuing device further defining a reference position along the transport belt between the taking up roller and the holding means for an output edge of a last stored banknote based on the height of the handled banknotes;

wherein said electronic unit controls said holding means and said driving circuit on the basis of an algorithm of entering associated to physical parameters of said storing and issuing device, the transport velocity and the height of the handled banknotes, information of transit from the sensor of output and stored parameters referred to detection and calculations effected on the last stored banknote; and wherein said electronic unit is provided for causing the last stored banknote to be arrested so as to position its output edge at said reference position and for causing an entered banknote to be arrested with respect to the transport belt so as to position its input edge at said reference position, with void space queuing with respect the last stored banknote and such to provide the input edge of said entered banknote to be spaced apart from 0.0 mm to 3.0 mm from the output edge of the last stored banknote.

2. A storing and issuing device for banknotes and/or other flexible documents, for use in an equipment for the automatic processing of banknotes including a transport mechanism for moving entering banknotes serially and in a spaced way at a transport velocity, wherein said storing and issuing device handles banknotes of a given height and includes an interface for receiving and issuing the banknotes from the transport mechanism, a taking-up roller, a motor of the taking-up roller, at least one transport belt provided for wrapping on the taking-up roller together with the banknotes, a sensor of output downwardly from said interface for detecting the passage of banknotes, holding means arranged downwardly from the sensor of output for enabling an entering banknote to slide on the transport belt under the action of the transport mechanism and wherein said holding means are actuatable for engaging the entering banknote with the transport belt for the transport along a given path, and an electronic unit for the holding means and the motor of the taking-up roller;

wherein said storing and issuing device defines a reference position on a path of the banknotes downwardly from said holding means;

wherein said reference position is provided to be common to an output edge of a last stored banknote and an input edge of the entering banknote;

wherein said electronic unit controls the holding means and the motor of the taking-up roller on the basis of an algorithm of entering associated to physical parameters of said storing and issuing device, the transport velocity and the height of the handled banknotes, information of transit of the entering banknotes from the sensor of output and stored parameters referred to detection and calculations effected on the last stored banknote; and wherein said electronic unit is provided for driving the motor of taking up roller to cause the output edge of the last stored banknote to be arrested at said reference position and for causing the holding means to engage the entering banknote with the transport belt when the input edge of said entering banknote reaches said reference position, in order to store the entering banknote with void space queuing with respect to the last stored banknote as contact or close contiguity between the input edge of the entering banknote and the output edge of the last stored banknote.

3. Storing and issuing device according to claim 2, wherein said reference position depends on the height of the handled banknotes and is arranged between a first position, for lower height banknotes, close to the holding means and a second position, for greater height banknotes, spaced away from the holding means.

4. Storing and issuing device according to claim 2, further comprising a feeding roller and a motor of the feeding roller, wherein the transport belt is normally wound on the feeding roller and unwinds from the feeding roller to be wound on the taking-up roller together with the banknotes, wherein, for a mode of issuing, the electronic unit is pre-set for driving the motor of the feeding roller for rewinding the transport belt on the feeding roller and causing a banknotes to be issued to be taken by the transport mechanism to move the banknotes to be issued in spaced way, one from the other, at said transport velocity and wherein, after issuing of a banknote, said electronic unit is provided for driving the motor of the taking up roller to position the output edge of the last stored banknote at said reference position.

5. Storing and issuing device according to claim 4, wherein the motor of the feeding roller is controlled by said electronic unit on the basis of an issuing algorithm associated to physical parameters of the storing and issuing device, the height of the banknotes, the transport velocity and information of passage of the banknotes to be issued.

6. Storing and issuing device according to claim 4 further comprising a sensor of input arranged along the path for the banknotes adjacent to the taking-up roller, and wherein the electronic unit controls the motor of the feeding roller in response to signals from the said sensor of input.

7. Storing and issuing device according to claim 6, wherein said electronic unit starts up the motor of the feeding roller on the basis of information of storage regarding the last stored banknote and updates said information of storage on the basis of signals from the sensor of input regarding banknote in transit and to be issued.

8. Storing and issuing device according to claim 7 wherein, for issuing more banknotes in sequence, the electronic unit updates the information of storage on the basis of signals from the input sensor for the first banknote in transit and to be issued, and on the basis of the number of issued banknotes for the following banknotes in transit.

9. Storing and issuing device according to claim 2, wherein the motor of the taking-up roller is a stepping motor and wherein said driving circuit defines a servocontrol of open loop type.

10. Storing and issuing device for banknotes according to claim 2, further comprising a diverter actuatable for deviating the entering banknotes from the transport mechanism toward the holding means, and wherein the sensor of output is arranged in the path for the banknotes between the diverter and the holding means.

11. Storing and issuing device for banknotes according to claim 10, wherein the motor of the taking-up roller is a stepping motor and wherein said electronic means controls said stepping motor as a servocontrol of open loop type, the stepping motor is fed with respective pulses, while the sensor of output generates a signal of transit depending on the transit of the banknote as delimited by the input edge and the output edge, and wherein the electronic unit takes count of the number of pulses of the stepping motor fed during the generation of said signal of transit for calculating residual number of pulses missing for the arrest of the input edge at said reference position and drives the stepping motor according to said residual number of pulses.

12. Storing and issuing device according to claim 10, wherein said electronic unit starts up the motor of the taking-up roller on the basis of stored information regarding the last stored banknote and updates said stored information on the basis of signals from the sensor of output regarding the banknote in transit and to be stored.

13. Storing and issuing device for banknotes according to claim 2, wherein said storing and issuing device constitutes an electronic module for being used in said equipment for the automatic processing of banknotes and wherein the transport belt is wound on a feeding roller rotated by a respective motor, said module further comprising an input sensor, arranged downwardly from the holding means, for revealing the transit of banknotes, and wherein for a mode of issuing, the electronic module controls the motor of the feeding roller and the holding means for rewinding the transport belt and leaving the banknotes to be issued in a spaced way, on the basis of an algorithm of issuing associated to given physical parameters of said storing and issuing device, the height of the banknotes and issue information of transit of the banknotes coming from said sensor of output and said input sensor.

14. Storing and issuing device for banknotes according to claim 2, wherein the holding means includes a pair of pinch rollers and an actuator controlled by said electronic unit for reciprocally moving the pinch rollers between a configuration of engagement in which the banknote can be dragged by the transport belt and a configuration of disengagement in which the banknote can slide with respect to the belt under the action of the transport mechanism, and wherein said sensor of output is arranged between the diverter and the pinch rollers.

15. Storing and issuing device for banknotes according to claim 14, wherein said actuator is an electromagnet and wherein, for a mode of storage, the electronic unit actuates said electromagnet for the engagement of the entering banknote with the transport belt at a given time (de-energization time Tel) beginning from the generation of the signal of said sensor of output and on the basis of the height of the banknote, the transport velocity and some of the physical parameters.

16. Storing and issuing device for banknotes according to claim 2, wherein the motor of the taking-up roller is a stepping motor and wherein the electronic unit starts up the stepping motor jointly with the generation of the signal of said sensor of output by the input edge of the entering banknote and counts the number of steps of the stepping motor up to the end of said signal by the trailing edge of the banknote and in which the electronic unit responds to the counted number of steps, and some of the physical parameters for calculating the stored parameters referred to detection and calculations effected on the last stored banknote and stores a calculated parameter for the positioning of a following banknote to be stored.

17. Storing and issuing device according to claim 2, wherein the input edge of the entered banknote is spaced apart from 0.0 mm to 3.0 mm with respect to the output edge of the last stored banknote.

18. A storing and issuing device for banknotes and/or other flexible documents, for use in an equipment for the automatic processing of banknotes including a transport mechanism for moving banknotes to be issued serially and in a spaced way at a transport velocity, wherein said storing and issuing device handles banknotes of a given height and includes an interface for receiving and issuing the banknotes from and to the transport mechanism, a taking-up roller, a motor of the taking-up roller, a feeding roller and a motor of the feeding roller, at least one transport belt provided for wrapping on the taking-up roller together with the banknotes and wherein the transport belt is normally wound on the feeding roller and unwinds from the feeding roller to be wound on the taking-up roller together with the banknotes, a sensor of output downwardly from said interface for detecting the passage of banknotes, holding means arranged downwardly from the sensor of output and wherein said holding means includes a pair of pinch rollers and an actuator for reciprocally moving the pinch rollers between a configuration of engagement in which the banknote can be dragged by the transport belt and a configuration of disengagement in which the banknote can slide with respect to the belt, and an electronic unit for the actuator of the holding means and the motors of the taking-up roller and the feeding roller;

wherein the stored banknotes are wrapped on the take-up spool with void space queuing between an output edge of a given banknote and the input edge of an adjacent banknote;

wherein said storing and issuing device defines a reference position on a path of the banknotes downwardly from said pair of pinch rollers;

wherein, for a mode of issuing, the electronic unit is pre-set for driving the motor of the feeding roller for rewinding the transport belt on the feeding roller and causing a banknotes to be issued to be dragged by the transport belt and to be taken by the transport mechanism to move the banknotes to be issued in spaced way, one from the other, at said transport velocity;

wherein the motor of the feeding roller is controlled by said electronic unit on the basis of an issuing algorithm associated to physical parameters of the storing and issuing device, the height of the banknotes, the transport velocity and information of passage of the banknotes to be issued; and wherein, after issuing of a banknote, said electronic unit is provided for driving the motor of the taking up roller to position the output edge of the last stored banknote at said reference position.

19. Storing and issuing device according to claim 18 further comprising a sensor of input arranged along the path for the banknotes adjacent to the taking-up roller, and wherein the electronic unit controls the motor of the feeding roller in response to signals from the said sensor of input.

20. Storing and issuing device according to claim 18, wherein said electronic unit starts up the motor of the feeding roller on the basis of information of storage regarding the last stored banknote and updates said information of storage on the basis of signals from the sensor of input regarding banknote in transit and to be issued.

* * * * *